US005334120A

United States Patent [19]

Rasmussen

[11] Patent Number: 5,334,120

[45] Date of Patent: Aug. 2, 1994

[54] GRAVITY SLED EXERCISE MACHINE

[76] Inventor: Aaron P. Rasmussen, 1776 Essex St., El Cajon, Calif. 92020

[21] Appl. No.: 153,988

[22] Filed: Nov. 18, 1993

Related U.S. Application Data

[63] Continuation-in-part of Ser. No. 41,978, Apr. 2, 1993, abandoned.

[51] Int. Cl.[5] ..... A63B 21/06

[52] U.S. Cl. ..... 482/97; 482/96; 482/101; 482/102; 482/135; 482/142; 482/145

[58] Field of Search ..... 482/95, 96, 94, 97-103, 482/113, 133-138, 142-146

[56] References Cited

U.S. PATENT DOCUMENTS

| | | | |
|---|---|---|---|
| 2,783,045 | 2/1957 | Bosch | 482/96 |
| 3,658,327 | 4/1972 | Thiede | 482/96 |
| 4,101,124 | 7/1978 | Mannke | 482/96 |
| 4,176,836 | 12/1979 | Coyle | 482/96 |
| 4,629,185 | 12/1986 | Amann | 482/113 |
| 4,700,946 | 10/1987 | Breunig | 482/96 |
| 4,706,953 | 11/1987 | Graham | 482/96 |
| 4,911,438 | 3/1990 | Van Straaten | 482/96 |
| 5,066,005 | 11/1991 | Luecke | 482/96 |
| 5,169,363 | 12/1992 | Campanaro et al. | 482/96 |

*Primary Examiner*—Robert Bahr

[57] ABSTRACT

A Gravity Sled Exercise Machine wherein leveraged body forces act to overcome gravity to move a two piece body sled and client upward, along biangular support rails, from a horizontal to a vertical orientation. To support the torso during the change in spatial orientation, a fixed angle sled seat reciprocates in lineal motion on the lower of two differentially inclined rails. In concurrent action, the lower section of a back rest pivots on an axle at the rear of the seat, while its upper end rides via a pivot guide on the upper, more vertically inclined rail. That kinetic linkage produces a curvilinear motion that constantly repositions the sled and introduces variable resistance to the exercise cycle.

An arrangement of handrings, lines and pulleys provides the leverage for arm and upper body exercises, while Class I and II levers enable leg and lower body exercises. A flexible coupling attaches a leg lever assembly to either the static lower rail or to the moving sled seat. The rail attachment allows the arms and legs to work in concert, while the seat attachment places them in opposition.

Machine resistance is gravity controlled by body/sled weight, and rail angles, supplemented with an optional arrangement for adding weightedness to the sled.

13 Claims, 5 Drawing Sheets

GRAVITY SLED EXERCISE MACHINE

This application is a continuation-in-part of application Ser. No. 08/041,978, filed Apr. 2, 1993, now abandoned.

BACKGROUND OF THE INVENTION

Relevant to the field of inquiry, is prior art featuring inclined body support means, drawn and/or pushed upon rail or rails with various leveraging systems. Together they comprise a special group of gravity sensitive machines that support the body and offer traction type exercise cycles. Of the art reviewed, one apparatus, proposed by Randy Coyle in U.S. Pat. No. 4,176,836, issued on Dec. 4, 1979, describes a means for introducing variable resistance to the exercise cycle. Mr. Coyle's discrete curved incline served the variable resistance objective well and correctly identified the benefits of matching machine mechanics with body force curves. Unfortunately, if generalized to broader applications, as might be envisioned in machines that exercise both arms and legs, the radial incline pattern presents body containment problems. Tests conducted by the applicant on total body prototypes employing the curved rail principle, indicate that, even when a seat is provided, some means of seat positioning is required to counteract tip out at the more vertical stages of sled ascent. Other, lesser problems associated with the curved rail design pertain to secondary forming defects. Curved structural elements are expensive and more subject to contour and cross section irregularities, wrinkling, and buckling than are straight line, mill formed elements.

The present invention envisions a machine design that offers variable resistance benefits, absent the discussed body containment and forming difficulties. A special series of sequential drawings, FIGS. 2A, 2B, 2C and 3A, 3B and 3C companion the summary to illustrate the essential elements of two distinct kinetic exercise cycles and to identify the essential structural and operational uniqueness of the present invention.

SUMMARY OF THE INVENTION

The gravity sled invention contemplates a total body exercise apparatus consisting of a two piece body sled drawn, with arm and leg efforts, over a biangular set of differentially inclined rails 20 and 24, as shown in the 2A through 3C drawing series, to produce fixed angle lineal ascent of the sled seat truck 28 and curvilinear ascent of the sled back rest 29 to reposition the body to meet the biomechanical requisites of the exercise cycle.

The summary description with drawing FIGS. 2A, 2B, and 2C illustrate biomechanical interaction of a female client and apparatus when the leg lever mechanism 88, is coupled in fixed position to the sled rail receptacle 129. The summary description with drawing FIGS. 3A, 3B, and 3C illustrate biomechanical interaction of a male client and apparatus when the leg lever mechanism 88, is coupled to the seat truck receptacle 128, to be towed in unison with the Gravity Sled. With either of the coupling options, the Gravity Sled provides upper and lower body exercises with minimum spinal compression. Upper body exercises work the muscles of the back, chest, arms and shoulders with traction type resistance movements similar to those found in the chin-up and parallel bar dip except that the movements are modified in severity with arm and leg leveraging means.

Referring now to drawing FIG. 2A, the female client, resting on the body sled 28 and 29, grasps the handrings 72 and forces them downward. As that thrust is begun, the sled is drawn upward on biangular rails 20 and 24. Assent continues and the effort cycle approaches midpoint, as shown in FIG. 2B. The force of gravity is now increasing, but is mitigated because the biangular rails produce a favorable change in anatomic position that enables the client to accommodate the increased resistance. FIG. 2C represents the conclusion of an effort cycle that not only works the upper body, but which also provides lower body exercise to work the legs, trunk, and abdomen. In the static coupling option, either the arms or legs can force the sled upward, or they can work in cooperation to accomplish that end. The first option, letting one muscle group do the work and allowing the other to passively absorb the motion, offers advantages for therapeutic rehabilitation of limbs and body regulatory systems. At the end of the effort cycle, a gravity cycle returns the sled to the position shown in FIG. 2A.

FIG. 3A, with male client, illustrates a dynamic coupling in which leg lever 88 is towed to follow the upward travel of the body sled. It should be noted that flexible coupling 120 is now hooked to the seat tow bar 128 and adjustment clamp 77 has been moved to reposition hand rings 72. The flexible coupling length has also been adjusted to reposition leg lever assembly 88. At the midpoint of the dynamic effort cycle, shown in FIG. 3B, foot cradle 98 has pivotally adjusted to accommodate the change in body position. During this effort cycle, the arms and legs are competing (working in opposition to one another) allowing the client to select the level of difficulty. Also, in this phase of the cycle, strong abdomen assistance reduces the force on leg lever 88 and helps the arms overcome gravity to facilitate upward movement of the sled on biangular rails 20 and 24. In FIG. 3C, the legs are in tuck position and the arms extended fully downward, in contrast to the anatomic position shown in FIG. 2C. The gravity return cycle offers the opportunity to utilize strong leg action when opposed with arm restraint at the rings. In either the static or dynamic coupling modes, the machine is gravity sensitive; that is, the level of difficulty is influenced by the body weight of the client plus added gravity when attached to weighed lever 136. The level of resistance is also controlled in the dynamic coupling mode by resistance between upper and lower body muscle groups. The above referenced drawings and summary have been employed to describe full cycle exercise routines, but the equipment can also accommodate passive and partial cycle exercises for limited capacity clients.

One of the objectives of the invention was to produce a variable resistance exercise apparatus that would correlate the resistance curve with the anatomic strength curve.

Another objective of the invention was to structure kinematic interaction between the torso sled and the biangular rails to adjust body position to meet cyclic exercise requirements.

Another object of the invention was to provide a constant angle means of seat travel to support the buttocks and lower body irrespective of body angle or assent status.

Another object of the invention was to adapt standard pulley systems and leverage means to provide mechanical advantage for arm and leg exercise functions, and to ratio the movement of body parts with sled movements.

Another objective of the invention was to provide an optionally attached assembly of leveraged weights, synchronized to mirror changes in sled gravity.

Another object of the invention was to provide a flexible coupling means for attachment of the leg exercise assembly to the lower inclined rail for combining the force of arm and leg actions, or as an option, attachment of the leg exercise assembly to the sled seat to complete a towing arrangement and place arm and leg forces in opposition one with the other.

PREFERRED EMBODIMENT OF THE INVENTION

Figure 1:
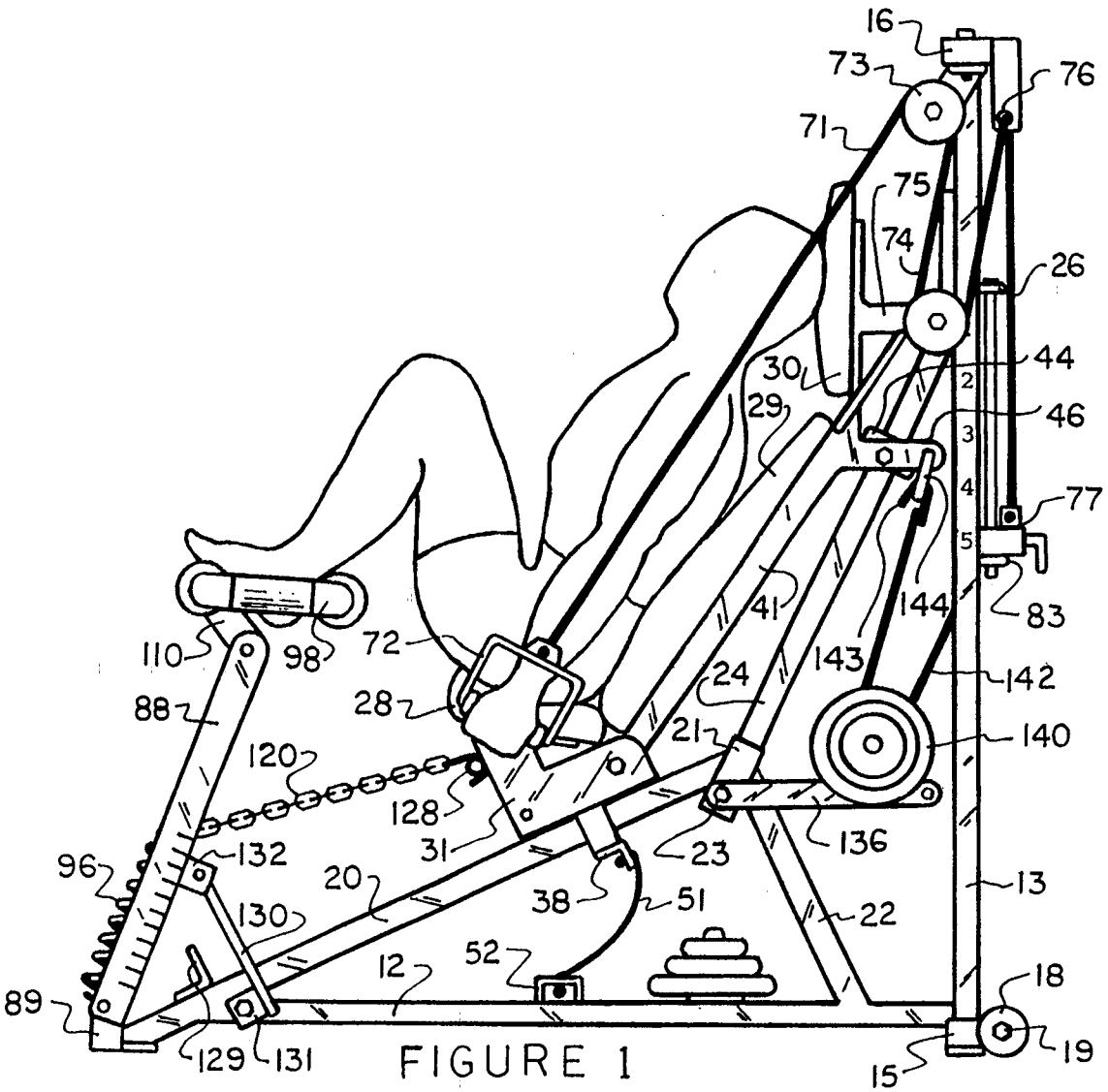
FIG. 1 is a right side assembly drawing illustrating the association of individual components of the Gravity Sled exercise machine.
Figure 2A:
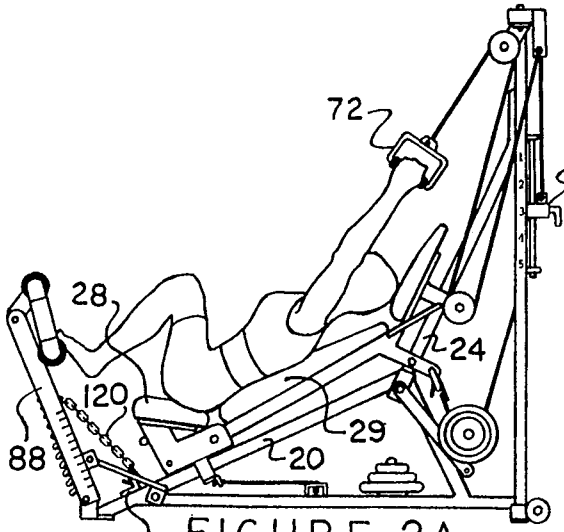
FIG. 2A presents a right side orthographic view of the machine with female client in the at rest position of the torso sled, set to begin an effort cycle that will illustrate the biomechanical kinetics of person and machine when the leg lever mechanism is coupled in fixed position to an eyelet receptacle of the frame rail.
Figure 2B:
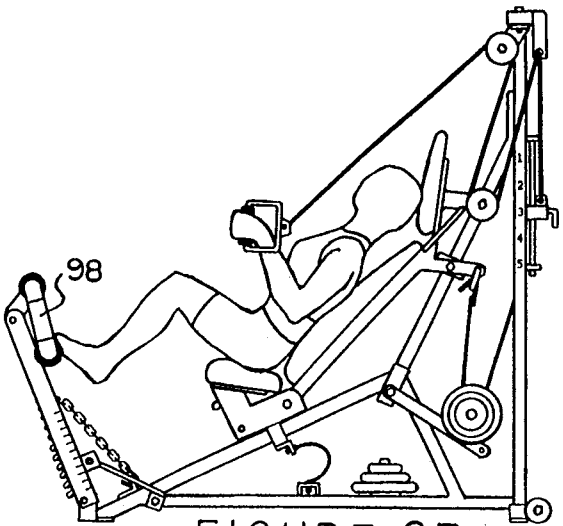
FIG. 2B illustrates the female client at the midpoint of the effort cycle with both arms and legs in a position to work in concert to overcome gravity and advance the body sled from a horizontal to vertical orientation on the rails.
Figure 2C:
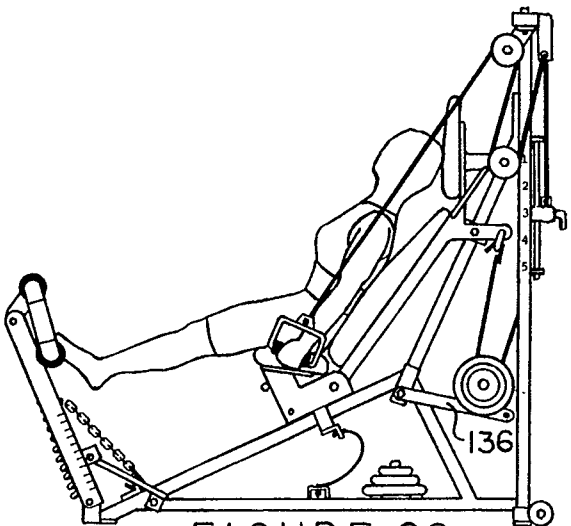
FIG. 2C portrays maximum extension of the female client, marking the transition from the effort cycle to the gravity cycle which returns the sled and client to the original at rest position shown in FIG. 2A.
Figure 3A:
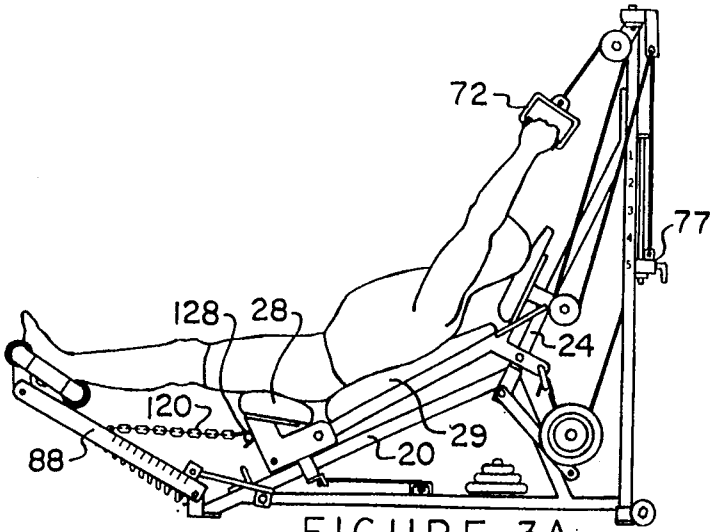
FIG. 3A is a right side orthographic view of the exercise machine with male client in the at rest position, set to begin the effort cycle that will illustrate the biomechanical kinetics of person and machine when the leg lever mechanism is coupled to trail in dynamic unison with a tow bar receptacle attached to the seat truck.
Figure 3B:
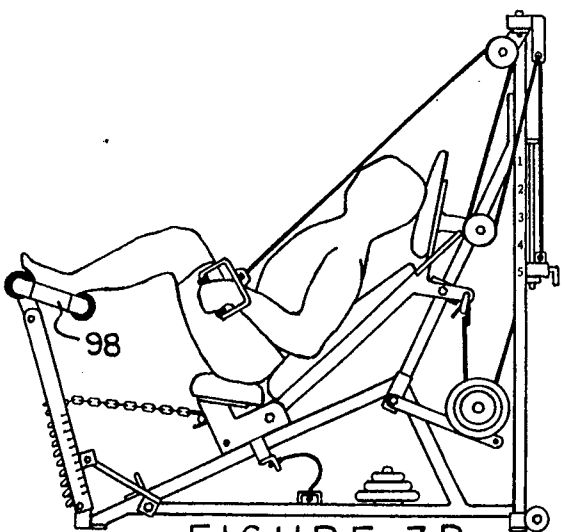
FIG. 3B shows the male client at the midpoint of the effort cycle, a view illustrating the connective mechanics that structure opposition of upper and lower body muscle groups during the ascent and descent of the sled.
Figure 3C:
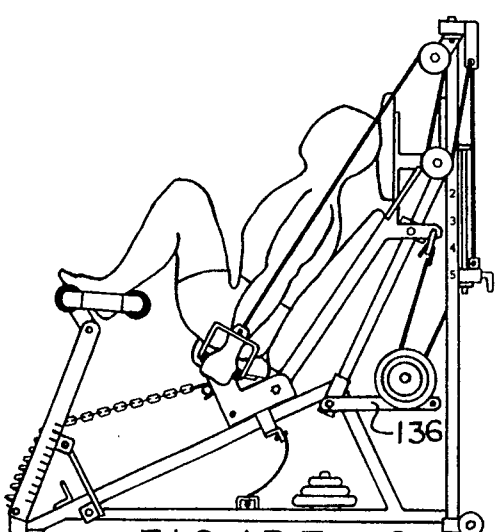
FIG. 3C portrays the position of the male client and sled at the maximum extension of the effort cycle. During the subsequent gravity cycle, the sled descends to the at rest position with the tether restraint line in taut condition. The dynamic coupling, of the leg assembly to the sled, offers continued client control of body initiated resistance. It may be noted in FIG. 3C that the seat truck continues to offer buttock support, even as the sled moves in curvilinear travel to a near vertical position.
Figures 4A, 4B:
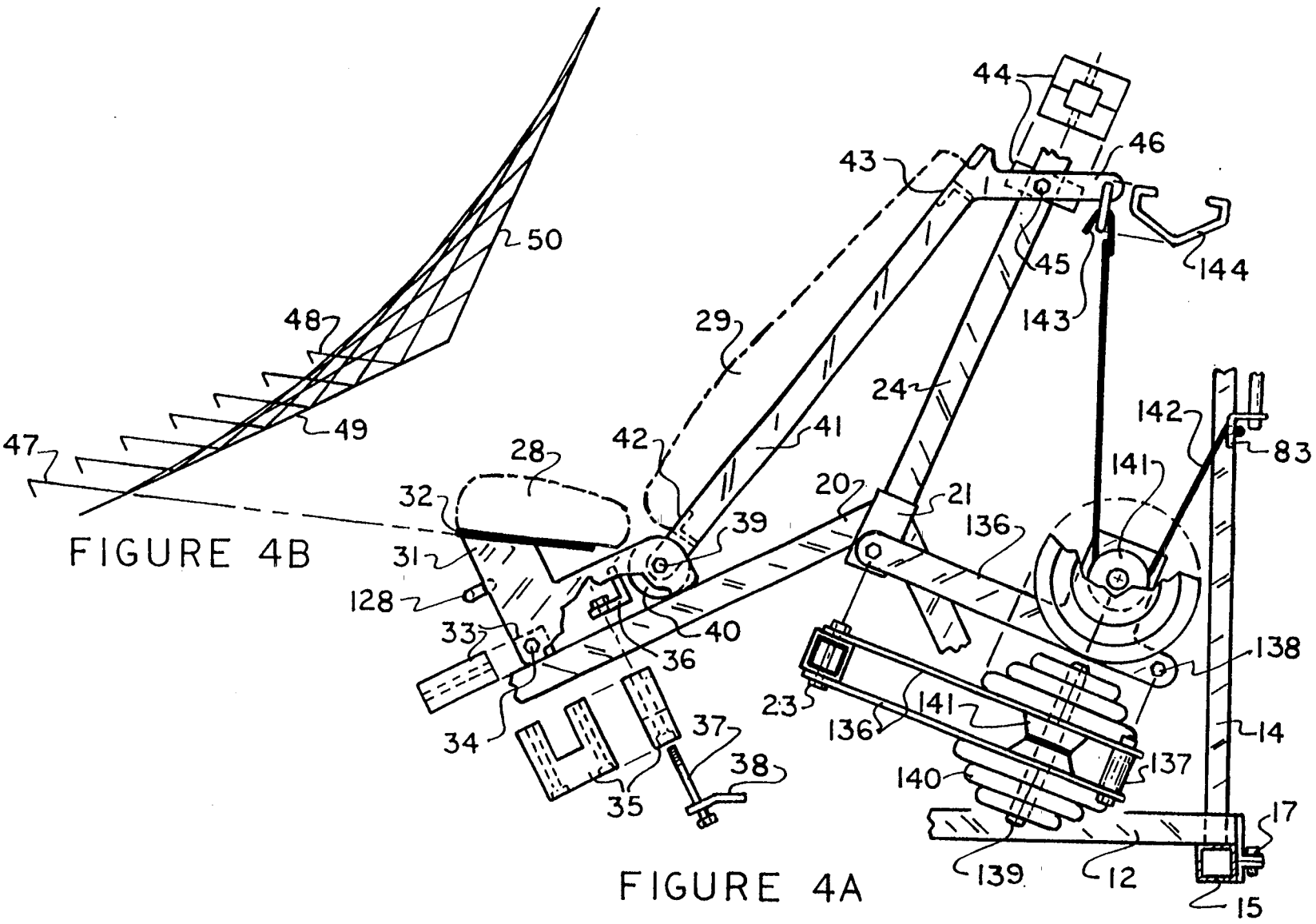
FIG. 4A provides a partial right side drawing of the Gravity Sled with auxiliary views that describe details of the sled, rail connective structure and means for adding weightedness to the sled.
FIG. 4B is a schematic representation of the planar movement of the seat truck and backrest components of the torso sled as it moves from a horizontal to a vertical spatial orientation.
Figure 5:
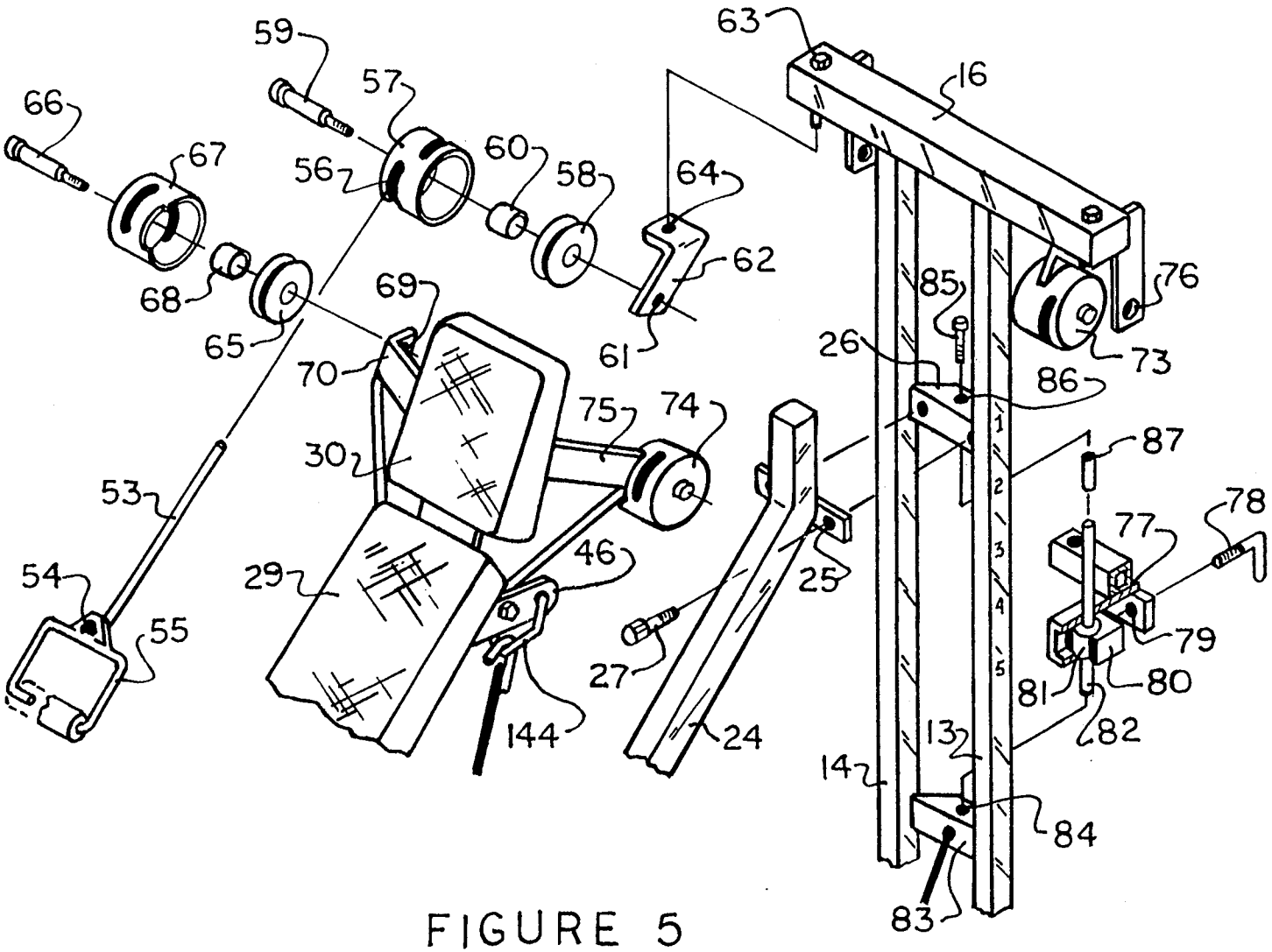
FIG. 5 is a pictorial view of the top section of the frame and sled with exploded views to illustrate hidden components of the lift means and adjustable clamp.

The Gravity Sled Exercise Machine shown in FIG. 1 has horizontal frame member 12 and a vertical frame having uprights 13 and 14, with crossbar 15 at the base and tee bar 16 at the top. FIG. 4A illustrates an assembly means 17 that joins frame 12 with crossbar 15. At its endpoints, one of which is shown in FIG. 1, crossbar 15 accepts transport wheel 18 with assembly bolt 19. Rail 20 is weldment joined at its front end to frame member 12 and at its back end to sleeve 21. Support member 22 joins sleeve 21 to frame member 12 as a secondary support means. Fitted and retained in sleeve 21 with lynch pin 23 is rail 24. At its top end as shown in FIG. 5, rail 24 has welded bracket 25 aligned to join spacer angle 26 which is weldment attached to uprights 13 and 14. Typical bolt 27 secures the union at each side of spacer angle 26.

Carried on the described biangular rails 20 and 24 of FIG. 1, is a torso support sled having seat truck assembly 28, backrest assembly 29 with headrest assembly 30 and support structure as follows: FIG. 4A illustrates the right side of two seat truck frame members 31, laterally spaced with platform 32, transported in lineal fashion on rail 20 by glide block 33 with fastener 34, and with guide block 35, bolted at either side of rail 20 to angle brace 36 with fastener 37 and tether bracket 38. Axle 39 supports roller 40 at the back end of seat frame 31. Two parallel rails 41 also pivot at each side of axle 39. Said rails support back rest assembly 29 and are spaced with support angles 42 and 43. At its top end, backrest 29 is centrally supported on pivot block 44 with typical stud 45 threaded through either side of U frame 46 to act as a fulcrum for pivot block 44. As indicated, the seat truck assembly 28 rides exclusively on rail 20, but the backrest assembly 29 rides on both rail 20 and on the more vertically inclined rail 24. Thus, the seat truck assembly travels a lineal pathway with parallel planar advancement while the backrest assembly moves in a curvilinear motion.

FIG. 4B illustrates the parallel lines produced by the lineal movement of seat truck assembly 28 from a starting planar position 47 to finish planar position 48. FIG. 4B also plots the curvilinear movement of back rest assembly 29 from a starting horizontally inclined angle 49 to a vertically inclined angle 50. That kinematic cycle repositions the upper body to accommodate exercise objectives, yet maintains constant support for the buttocks and trunk throughout the exercise cycle.

Referring again to FIG. 1, the upper and lower limits of extension for the torso support sled as it travels on the biangular rails is controlled by tether 51 , a line that connects bracket 38, of seat truck 28, with channel 52 which is weldment joined to horizontal frame member 12. The tether means of control avoids pinch points common when stop blocks are employed to limit travel.

Upper movement of the described torso sled is powered by the exercise client and is therefore considered the effort cycle, while downward movement is influenced by gravity and, for the purpose of this explanation, will be referred to as the gravity cycle. Upper body exercise is made possible with a connecting means consisting of compound assembly of pulleys connected with lines, fixed to an adjustable clamp at one end and to a set of hand rings at the other. The object of that assembly is to transmit a leveraged force from rings to sled and proportion sled movement relative to ring movement. Connective details of the pulley assembly means may be understood from two drawing figures. FIG. 1 illustrates the pathway of lines from a right side view, and FIG. 5 shows an exploded view of assembly components with auxiliary and broken out sections to illustrate hidden structure.

In FIG. 5, line 53 penetrates hole 54 of hand ring 55 and is knotted in place. Line 53 is then shown to pass through slot 56 of protective sheath 57 to engage pulley supported, in the exploded view, on shoulder bolt 59, which passes through sheath 57, bushing 60, and pulley 58 to thread into hole 61 of offset pulley bracket 62. Bracket 62 is then rotatably mounted under tee bar 16 with shoulder bolt 63 which threads into hole 64 of bracket 62. The offset structure of pulley bracket 62 provides lateral movement of the leading edge of pulley 58 to enable enhanced exercise routines, and maintains a position of alignment with other pulleys at the trailing edge of pulley 58. To accomplish that objective, the trailing groove of pulley 58 is aligned with the axis of shoulder bolt 63.

Moveable sled pulley 65 has a housing assembly similar to that of pulley 58, wherein shoulder bolt 66 penetrates sheath 67 and bushing 68 to circumscribe pulley 65 and thread into hole 69 of wing mount 70 at the top of the sled backrest.

FIG. 1 illustrates the sequential path of right side line 71 as it leaves handring 72, moving upward to traverse through lateral pulley assembly 73, emerging therefrom to run downward to circumscribe moveable pulley 74 attached to wing mount 75. Upon exiting the rear of pulley 74, line 71 again travels upward to be drawn, at a sharp angle, through eye hanger 76, after which line 71 is joined to an adjustable line clamp 77. The described cycle of pulley connecting means provides a 2:1 ratio of ring movement as compared to sled travel and reduces the gravitational load at the rings by half. Adjustable clamp 77 regulates ring positions to fit the exercise client. A sectioned view of this clamp, as shown in FIG. 5, reveals its composition and details its operation. When thrust screw 78 is loosened in threaded hole 79, it relieves pressure on brake shoe 80 and brake sleeve 81, which surrounds vertical rod 82. At its bottom end, rod 82 penetrates spacer angle 83 through hole 84 and is supported in position at the top end by fastener 85 passing through spacer angle 26 at hole 86 to thread into bar 82 at point 87. Tightening thrust screw 78 sets the clamp in a desired position as identified by number on adjacent upright 13.

Figure 6:
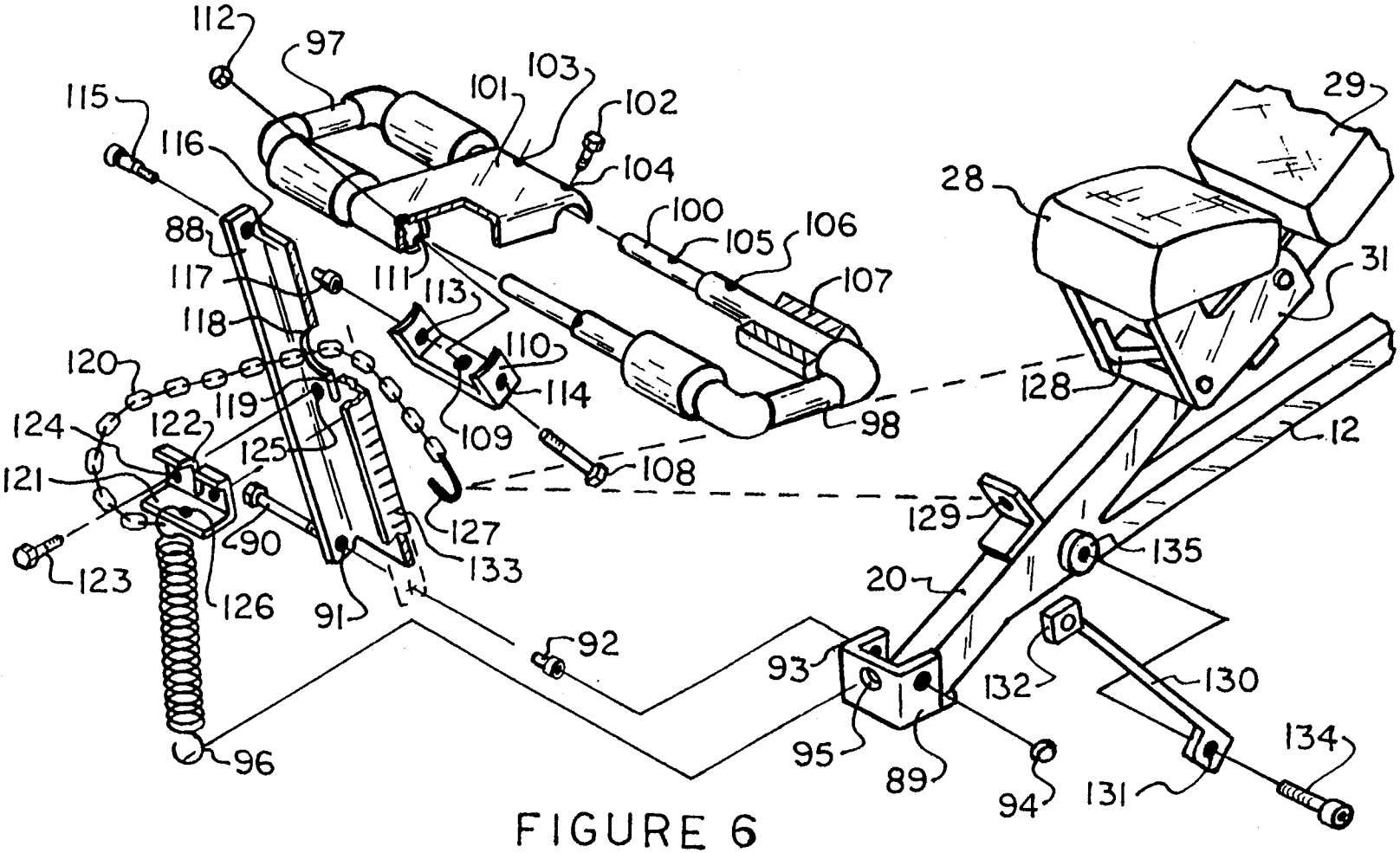
FIG. 6 is a pictorial view of the bottom section of the frame and sled illustrating exploded view components of the leg lever mechanism and coupling means.

Shown in an exploded view of FIG. 6 is a leg lever assembly designed to provide lower body exercise. A partial section view of the components in that assembly illustrates an aluminum channel leg lever 88 shown to be pivotally supported at either side of shoe 89 of rail 20. In that drawing, bolt 90 is shown to assembly align with hole 91, bushing 92 and hole 93 of shoe 89. The missing right side of that assembly mirrors the left side with cap nut 94 completing the lever mounting means. Shoe 89 also has a keyhole 95 at its front surface to serve as a retainer for the end of tensioning spring 96.

Mounted in rotatable fashion at the top of lever 88 is a foot support cradle. A pair of U shaped frames of cement bonded PVC, 97 and 98, are shown in exploded view in FIG. 6. Frame 97 sleeves over two round section of pipe numbered 99 and 100, which enable the frames to be joined and reinforced. When assembled, face plate 101 covers the PVC joint and two screws, identical to screw 102, enter holes 103 and 104 to thread into holes 105 and 106 of pipe 100. Prior to assembly, four foam pads, illustrated by sectioned pad 107, are slid over the PVC walls to serve as footrests. At the front end, bolt 108 penetrates hole 109 of bracket 110 and passes through hole 111 of the assembled PVC frames and facing plate and is clamped in place with cap screw 112. At either side of bracket 110 are threaded holes 113 and 114. Each of these holes receives a shoulder bolt as typified by bolt 115, shown assembly alignment with hole 116, bushing 117, and hole 113 to illustrate the rotational mounting of the foot cradle with the leg lever.

At the approximate mid point of leg lever 88 is shown hole 118, below which is chain slot 119. Passing through the hole is flexible coupling chain 120. The function of the chain slot is to lock in a selected chain link to adjust the flexible coupling length to client specifications. Backing angle 121, of steel, is also slotted at 122 to absorb wear. The backing angle is fastened to aluminum leg lever 88 with two machine screws, one of which is shown as screw 123, aligned to pass through hole 124 to thread into hole 125. At the lower lip of angle 121, is hole 126 to retain the upper end of tension spring 96. The end-link of chain 120 is hooked over the end loop of spring 96. At the other end of chain 120 is hook 127, which may be attached to tow bar 128 when a dynamic coupling is desired or it may be attached to rail eyelet receptacle 129 when a fixed coupling is preferred. Phantom lines illustrate the connecting routes.

A pointer rod 130 indicates the position of leg lever 88. It pivots on block 131 and bears on sliding block 132 to read on index marks 133 of leg lever 88. Fastener 134 penetrates block 131 and threads into boss 135 to permit rotation of the pointer arm.

FIG. 4A provides a right side auxiliary view of assembly means for adding optional weightedness to the torso support sled. In that illustration, a pair of parallel levers 136 pivot at one end on lynch pin 23 with spacer 137 and fastener 138 joining the opposite end. levers 136 support bar 139 which carries a client selected number of weight plates 140 mounted exterior to said levers, and pulley 141 within said levers. Line 142 extends from spacer angle 83, around pulley 141, to attach with linehook 143 to gravity hanger 144. The leveraged assembly approximates the variable load characteristics of the torso sled with a minimum of travel space.

What is claimed is:

1. A gravity sled exercise machine comprising:

a frame support structure having a horizontal frame member with a front end and a back end; a vertical frame member having two upright pieces joined at the top end with a perpendicular tee bar; a middle section joined with upper and lower spacer angles; a bottom end with means for joining said vertical frame member to the back end of said horizontal frame member;

a frame support structure to include a biangular arrangement of lineal rail members, consisting of an upper rail, angularly inclined in vertical orientation, with a top end and a bottom end; and a lower rail, angularly inclined in horizontal orientation, with a front end and a back end; said lower rail having an eyelet receptacle attached near the front end; means for joining said rail members to said vertical and horizontal frame members;

a two piece torso support sled engaged in multiangular movement on said upper and lower rail members;

a seat truck component of said support sled having a front end and a back end with tow bar receptacle attached to the front end;

a seat truck tracking means reciprocally engaged in lineal motion on said lower rail to produce fixed angle support of said sled seat truck;

a tether with attachment means for limiting the reciprocal movement of said seat truck on said lower rail;

a back rest component of said support sled to include a frame having a top end with a U bracket and guide support means engaged to travel on said upper rail, a bottom end with axial support means to provide pivotal connection to the back end of said seat truck; said guide support means in kinematic interaction with said axial support means to provide curvilinear motion with angular adjustment of said back rest during the ascent and descent of said torso sled;

a backrest component of said support sled having a headrest with integral pulley wing mounts attached the top end of said backrest component;

a gravity hanger pivotally attached to said back rest U bracket to accept additional weightedness;

a weighted lever assembly with pulley and line means for adding variable gravity to said torso support sled; means for coupling said line to said gravity hanger and to said frame support structure; means to pivot said lever on said frame support structure;

a pulley lift means, having hand rings, pulleys, lines and enabling structure to include an offset pulley bracket and eye hanger mounted at each end of said vertical frame tee bar;

a pulley lift means having an adjustable clamp means by which said hand rings are fitted to the reach of the exercise client; means for attachment of said adjustment clamp to said spacer angles of the vertical frame member;

a pulley lift means wherein a person, reclining on said torso support sled and grasping said hand rings, could use arm motion to move said sled upward on said biangular rails from a horizontal angle of orientation to a vertical angle of orientation;

a leg exercise means comprising a leg lever with a top end and an indexed bottom end, said bottom end having pivotal connection means to the front end of said lower rail; a foot cradle with pivot mounting means attached to the top end of said leg lever; a flexible coupling member with means for adjusting the length of said coupling member at the point of attachment to said leg lever; a tensioning spring with means for joining said spring to said leg lever and to the front end of said lower rail; a leg lever position indicator with pivotal means of attachment to the front end of said lower rail; and a leg exercise means whereby said leg lever is coupled by said flexible coupling means to either of two connective receptacles: attaching said coupling means to said eyelet receptacle at the front of said lower rail produces a static coupling and cooperative arm and leg interaction; attaching said coupling means to said tow bar receptacle produces a dynamic radial movement of said leg lever assembly and structures opposition of arm and leg forces.

2. The gravity sled exercise machine described in claim 1 wherein said biangular rails are arranged in lateral alignment to intersect at a given point; said upper rail joined by sleeve mount and lynch pin to said lower rail at said intersection.

3. The gravity sled exercise machine described in claim 2 wherein said joined biangular rails connect the top end of said vertical upright frame member with the front end of said horizontal frame member.

4. The gravity sled exercise machine described in claim 1 wherein said seat truck tracking means includes a glide block mounted at the front end, an axle and roller supporting the back end and a U shaped retainer block mounted at the center section to enclose said lower rail and prevent runout.

5. The gravity sled exercise machine described in claim 1 wherein said seat truck tether is attached with a weldment channel to said horizontal frame member and to a bracket bolted to said seat truck to limit the ascent and descent of said truck.

6. The gravity sled exercise machine described in claim 1 wherein said guide means to transport the top end of said backrest includes a pair of sliding retainer blocks pivotally mounted within said U bracket to follow said upper rail irrespective of angle changes associated with curvilinear ascent and descent.

7. The gravity sled exercise machine described in claim 2 wherein said lever, pulley and line to augment sled gravity includes a weighted lever pivotally suspended on said lynch pin at the intersection of said biangular rails; said lever having a pulley mounted opposite its pivotal end to receive said line which is connected at one end to said gravity hanger and attached at its opposite end to said lower spacer angle;

8. The gravity sled exercise machine described in claim 1 wherein said pulley lift means integrates a block and tackle system, with alignment and adjustment means to enable said leverage system, wherein two lines run from said hand rings upward to circumscribe two pulleys axially mounted to align the trailing groove of each pulley with the rotational axis connecting said offset bracket with said upright tee bar, said positioning to permit lateral swing of the leading groove of said pulley without disturbing the alignment of the outlet lines as they move downward to circumscribe two pulleys axially attached to said pulley wing mounts, thereafter, moving upward through said hanger eyes, and again sharply downward to connecting means of said adjustable clamp means;

9. The gravity sled exercise machine described in claim 1 wherein said adjustable clamp means includes a vertical rod with a top end and a bottom end, each mechanically attached to said upper and lower spacer angles of said vertical frame member; a housing fitted to slide over said rod to receive the ends of said lines and to house a brake drum enclosing said rod; a brake shoe and adjustor screw to apply or release pressure on said brake drum for reciprocal adjustment of line lengths.

10. The gravity sled exercise machine described in claim 1 whereby said flexible coupling means consists of a length of closed link chain with S hook connector means.

11. The gravity sled exercise machine described in claim 10 whereby said length adjustment means for attachment of said closed link chain, consists of said chain passing freely through a keyhole in said leg lever to a desired position, at which point, said chain is allowed to engage the slot of said keyhole.

12. The gravity sled exercise machine described in claim 1 whereby said foot cradle is enclosed to contain the feet with radial movement to satisfy human factors attendant with changes in torso position.

13. The gravity sled exercise machine described in claim 1 whereby said leg lever position indicator includes a pointer rod engaged in a pivot block axially attached to the front end of said lower rail, said pointer positioned to bear on said leg lever and to read on said index marks.

* * * * *